US010435922B2

(12) United States Patent
Kovie

(10) Patent No.: US 10,435,922 B2
(45) Date of Patent: Oct. 8, 2019

(54) VEHICLE HANDLE BEZEL ASSEMBLY HAVING A MOVABLE COVER

(71) Applicant: Nissan North America, Inc., Franklin, TN (US)

(72) Inventor: David Kovie, Livonia, MI (US)

(73) Assignee: Nissan North America, Inc., Franklin, TN (US)

( * ) Notice: Subject to any disclaimer, the term of this patent is extended or adjusted under 35 U.S.C. 154(b) by 191 days.

(21) Appl. No.: 15/642,063

(22) Filed: Jul. 5, 2017

(65) Prior Publication Data

US 2019/0010737 A1 Jan. 10, 2019

(51) Int. Cl.

| | |
|---|---|
| ***E06B 3/00*** | (2006.01) |
| ***E05B 79/06*** | (2014.01) |
| ***E05B 85/12*** | (2014.01) |
| ***E05B 15/00*** | (2006.01) |

(52) U.S. Cl.

CPC ..... *E05B 79/06* (2013.01); *E05B 15/0053* (2013.01); *E05B 85/12* (2013.01); *E05B 85/13* (2013.01)

(58) Field of Classification Search

CPC ..... E05B 85/10; E05B 85/16; E05B 85/12; B60R 13/0206; B60R 13/00; B60R 13/0243; B60R 2013/0287; B60R 2013/0293; B60R 2013/0281; B60J 5/0416; B60J 5/0434

USPC ..... 49/501, 502, 503; 296/146.7

See application file for complete search history.

(56) References Cited

U.S. PATENT DOCUMENTS

| | | | | |
|---|---|---|---|---|
| 5,377,450 | A * | 1/1995 | Varajon | E05B 85/12 292/336.3 |
| 7,343,646 | B2 * | 3/2008 | Hayashi | E05B 85/18 16/412 |
| 7,380,864 | B2 * | 6/2008 | Guanzon | E05B 79/06 16/412 |
| 7,404,588 | B2 * | 7/2008 | Gabsch | B60R 13/0206 296/146.7 |
| 7,905,059 | B2 | 3/2011 | Senoo | |
| 8,220,848 | B2 * | 7/2012 | Minemura | B29C 45/2708 292/336.3 |
| 8,443,552 | B2 * | 5/2013 | Kinoshita | B60J 5/0426 296/146.5 |
| 8,720,118 | B2 * | 5/2014 | Meyers | E05B 77/04 49/460 |
| 9,126,291 | B1 | 9/2015 | Thrasher | |
| 9,248,722 | B2 * | 2/2016 | Gillay | B60J 5/0416 |

(Continued)

FOREIGN PATENT DOCUMENTS

| | | | |
|---|---|---|---|
| DE | 102011011828 | A1 | 8/2012 |
| EP | 1438214 | A1 | 7/2004 |
| GB | 2261020 | B | 1/1995 |

*Primary Examiner* — Chi Q Nguyen

(74) *Attorney, Agent, or Firm* — Global IP Counselors, LLP

(57) ABSTRACT

A handle bezel assembly for a vehicle includes a handle bezel and a cover. The handle bezel has a first fastener opening formed therein. The first fastener opening is configured to receive a first fastener to secure the handle bezel to a closure panel assembly. The cover is movably connected to the handle bezel. The cover is movable between a first position preventing access to the fastener opening and a second position allowing access to the fastener opening.

20 Claims, 6 Drawing Sheets

(56) References Cited

U.S. PATENT DOCUMENTS

| | | | | |
|---|---|---|---|---|
| 2002/0084674 | A1* | 7/2002 | Dobson | B60R 13/0243 296/146.7 |
| 2003/0168875 | A1* | 9/2003 | Anderson | B60R 7/04 296/37.8 |
| 2007/0131003 | A1* | 6/2007 | Williamson | E05B 79/06 70/208 |
| 2007/0289222 | A1 | 12/2007 | Papi et al. | |
| 2014/0306484 | A1* | 10/2014 | Tranninger | C08F 10/06 296/187.01 |
| 2015/0368936 | A1* | 12/2015 | Chappuis | B60J 5/0416 49/460 |

* cited by examiner

VEHICLE HANDLE BEZEL ASSEMBLY HAVING A MOVABLE COVER

BACKGROUND

Field of the Invention

The present invention generally relates to a movable cover for a vehicle handle bezel assembly. More specifically, the present invention relates to a vehicle handle bezel assembly having a cover movable between positions preventing and allowing access to a fastener opening.

Background Information

Many current vehicles include a fastener that mounts a handle assembly to a closure panel. A fastener secures the bezel of the handle assembly to the closure panel. A cover member is removably connected to the bezel to cover the fastener after the handle assembly is mounted to the closure panel. To remove the handle assembly, the cover member is removed from the bezel to provide access to the fastener. Once the cover is removed from the bezel, the cover is no longer connected thereto such that the cover is easily misplaced or lost. Additionally, the cover can be marred during the removal process, such that a new cover is required to provide an aesthetically pleasing appearance upon reinstallation of the bezel. Further, the cover can also be damaged during the removal process, thereby requiring a new cover to properly connect to the bezel to conceal the fastener upon reinstallation of the bezel.

SUMMARY

In view of the state of the known technology, one aspect of the present invention includes a handle bezel assembly for a vehicle including a handle bezel and a cover. The handle bezel has a first fastener opening formed therein. The first fastener opening is configured to receive a first fastener to secure the handle bezel to a closure panel assembly. The cover is movably connected to the handle bezel. The cover is movable between a first position preventing access to the fastener opening and a second position allowing access to the fastener opening.

Another aspect of the present invention includes a closure panel assembly for a vehicle including an outer closure panel, an inner closure panel and a handle bezel. The inner closure panel is mounted to the outer closure panel. The handle bezel has a fastener opening and at least one mounting tab opening. The fastener opening receives a first fastener to secure the handle bezel to the inner closure panel. The at least one mounting tab opening receives a second fastener to secure the handle bezel to the outer closure panel. A cover is movably connected to the handle bezel. The cover is movable between a first position preventing access to the first fastener and a second position allowing access to the first fastener.

Also other objects, features, aspects and advantages of the disclosed movable cover for a vehicle handle bezel assembly will become apparent to those skilled in the art from the following detailed description, which, taken in conjunction with the annexed drawings, discloses exemplary embodiments of the movable cover for a vehicle handle bezel assembly.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
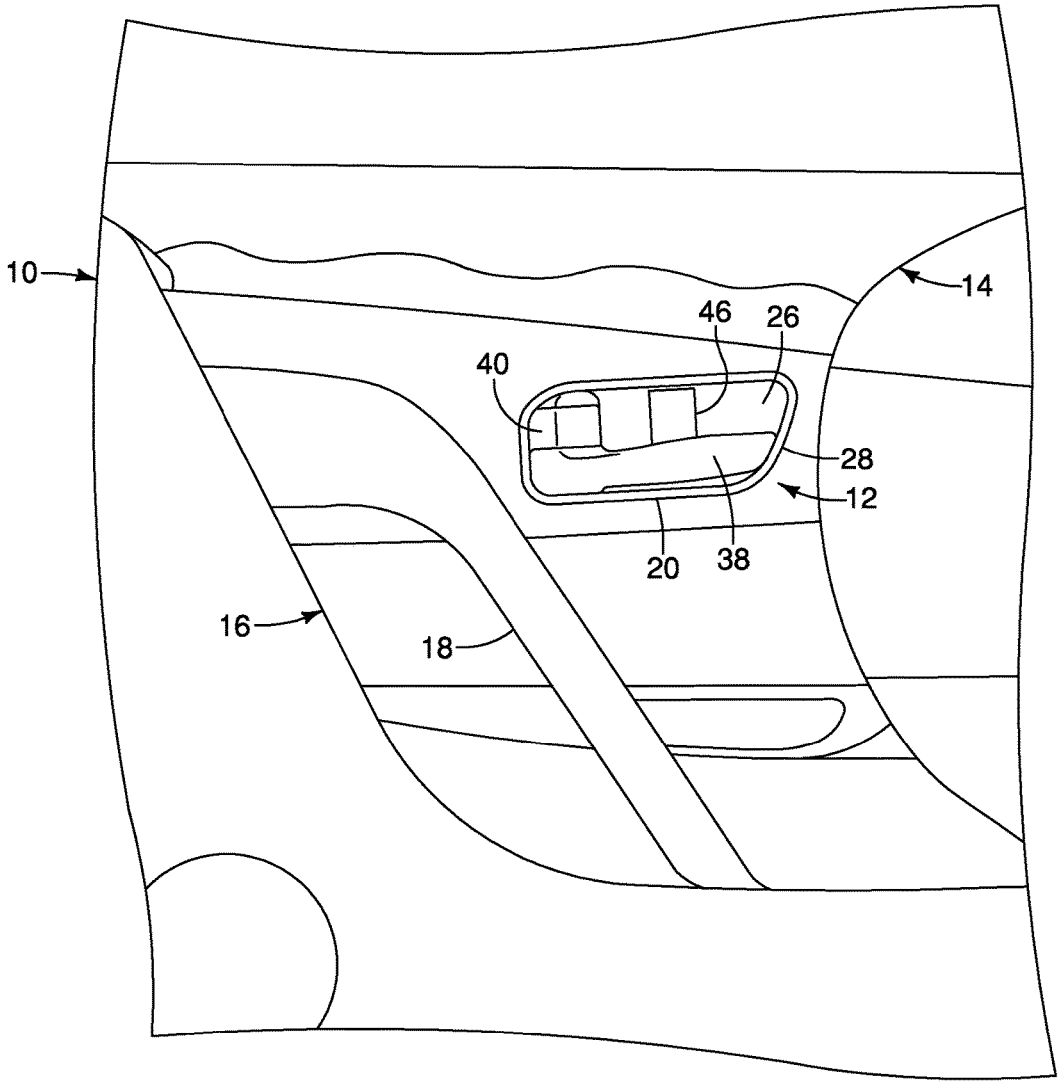
FIG. 1 is a side elevational view of a closure panel including a handle bezel assembly in accordance with an exemplary embodiment of the present invention.

Selected exemplary embodiments will now be explained with reference to the drawing figures. It will be apparent to those skilled in the art from this disclosure that the following descriptions of the exemplary embodiments are provided for illustration only and not for the purpose of limiting the invention as defined by the appended claims and their equivalents.

Referring initially to FIGS. 1-5, a vehicle includes a plurality of closure panel assemblies 10 (only one shown), each of which is equipped with a handle bezel assembly 12 in accordance with the present invention. Because the focus of the present invention is directed to the handle bezel assembly 12, the vehicle and the closure panel assemblies 10 will not be discussed or illustrated in detail herein. The right and left closure panel assemblies are substantially identical to each other, except that they are mirror images. The handle bezel assembly 12 is configured and arranged to operate a vehicle closure panel latch mechanism (not shown) in a conventional manner.

Basically, the vehicle closure panel assembly 10 has an outer closure panel 14 and an inner closure panel 16 that define a hollow cavity or interior 17 (FIG. 3) therebetween for receiving various conventional door elements and mechanisms that are well known in the art. The outer closure panel 14 is preferably a single panel structure made of a rigid material, such as a metallic material. The outer closure panel 14 includes a plurality of fastener openings configured to receive fasteners to mount the inner closure panel 16 thereto.

The inner closure panel 16 is coupled to the outer closure panel 14 in a conventional manner with fasteners, such as clips (not shown). The inner closure panel 16 is configured to conform to the shape of the outer closure panel 14 and has a contoured shape. The inner closure panel 16 is preferably constructed of a lightweight rigid material, such as a rigid plastic material. Thus, the inner closure panel 16 is preferably molded to form the interior shape of the outer closure panel 14. The inner closure panel 16 can include an integrally formed arm rest 18. The inner closure panel 16 further includes a closure panel handle opening 20 located adjacent the arm rest 18. The closure panel handle opening 20 is located in any suitable location such that the arm rest 18 does not interfere with operation of the handle bezel assembly 12.

Figure 3:
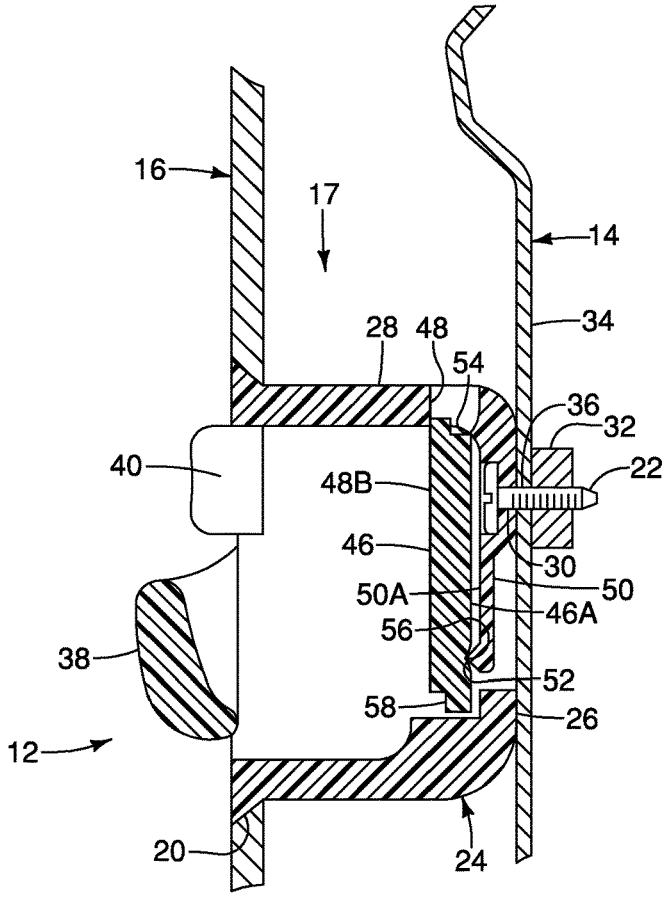
FIG. 3 is a front elevational view in cross section of the handle bezel assembly of FIGS. 1 and 2 with the cover in a first position.

As shown in FIG. 3, the handle bezel assembly 12 is fixedly coupled to the inner closure panel 14 of the closure panel assembly 10 via a first fastener 22, such as a fastening bolt. A first portion of the handle bezel assembly 12 is positioned in the cavity 17 between the outer closure panel 14 and the inner closure panel 16, while a second portion of the handle bezel assembly 12 protrudes outwardly through the handle opening 20 such that the handle bezel assembly 12 can be operated from the interior of the vehicle.

Figure 2:
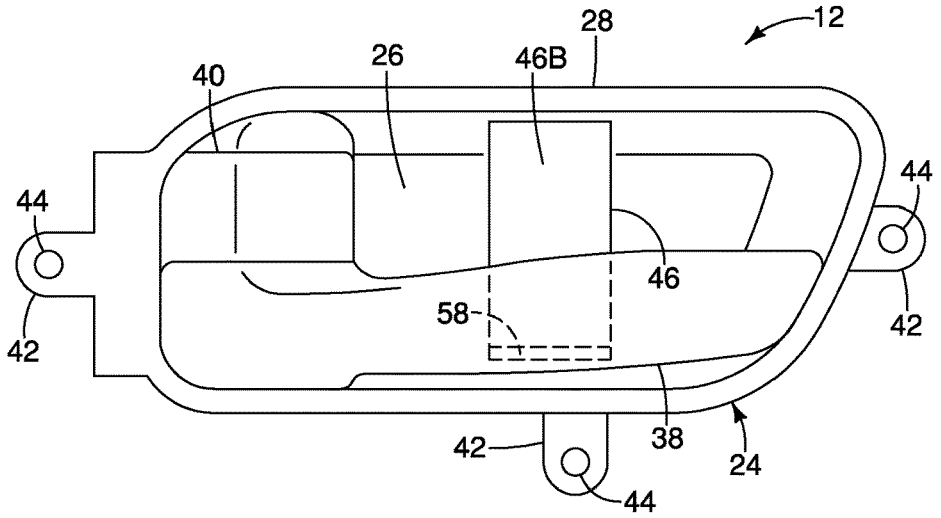
FIG. 2 is a side elevational view of the handle bezel assembly of FIG. 1 with the cover in a first position.

As shown in FIG. 2, the handle bezel assembly 12 includes a handle bezel 24 having a shape substantially corresponding to the shape of the closure panel handle bezel opening 20. As shown in FIG. 3, the handle bezel 24 is substantially U-shaped in cross section. The handle bezel 24 has a base member 26 from which a wall member 28 extends outwardly therefrom. The wall member 28 preferably extends outwardly around an entire perimeter of the base member 26. The wall member 28 extends from the base member 26 in a direction towards the interior of the vehicle. The handle bezel 24 is preferably unitarily formed as a one-piece member and is made of a plastic material. Still more preferably, the handle bezel 24 is injection molded. Alternatively, other suitable materials can be used.

The base member 26 of the handle bezel 24 has a first fastener opening 30 to receive the first fastener 22. A nut 32 is fixedly attached, such as by welding, to an outer surface 34 of the outer closure panel 16, such that the nut 32 is aligned with the first fastener opening 30 in the base member 26 of the handle bezel 24 and with a corresponding fastener opening 36 in the outer closure panel 16. The first fastener 22 securely mounts the handle bezel assembly 12 to the outer closure panel 16 of the closure panel assembly 10.

The handle bezel assembly 12 further includes a handle 38, as shown in FIGS. 1-5, pivotally connected to the handle bezel 24 to operate the latching mechanism (not shown) of the closure panel 10 in a conventional manner. A locking member 40 is pivotally connected to the handle bezel 24 to prevent operation of the handle 38 from operating the latching mechanism (not shown). The handle 38 and the locking member 40 are conventional members such that further description thereof is omitted.

Figure 4:
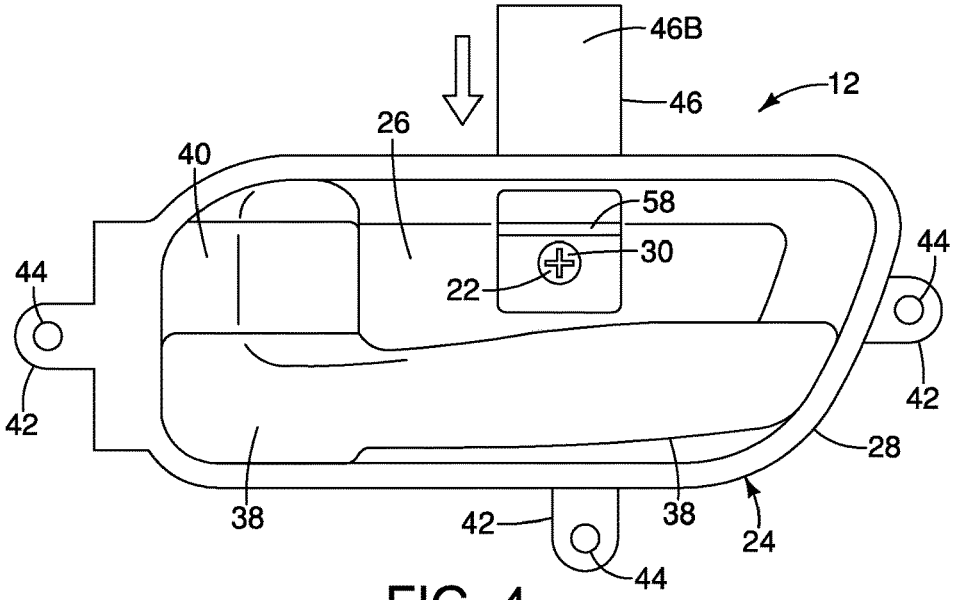
FIG. 4 is a side elevational view of the handle bezel assembly of FIG. 2 with the cover in a second position.

A plurality of mounting tabs 42 extend outwardly from an outer periphery of the wall member 28 of the handle bezel 24, as shown in FIGS. 2 and 4. Each mounting tab 42 has a second fastener opening 44 disposed therein. The second fastener opening 44 is configured to receive a second fastener to secure the handle bezel 24 to the inner closure panel 16 of the closure panel assembly 10. Although three mounting tabs 42 are shown in FIGS. 2 and 4, any suitable number of mounting tabs 42 can be used.

The handle bezel assembly 12 further includes a cover 46 movably connected to the handle bezel 24, as shown in FIGS. 1-5. The cover 46 is movable between a first position shown in FIGS. 1-3 in which access to the first fastener opening 30 is prevented, and a second position shown in FIGS. 4 and 5 in which the first fastener opening 30 is accessible.

Figure 5:
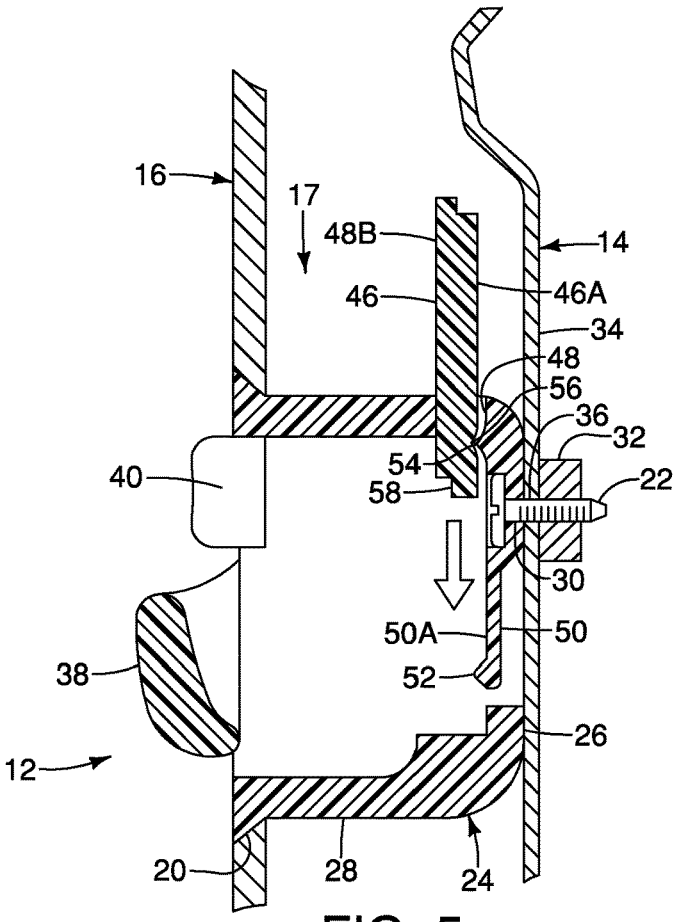
FIG. 5 is a front elevational view in cross section of the handle bezel assembly of FIG. 3 with the cover in a second position.

A slot 48 is formed in the handle bezel 24 to accommodate movement of the cover 46 between the first and second positions, as shown in FIGS. 3 and 5. The slot 48 is preferably disposed in the wall member 28 above the handle 38 and the locking member 40. The slot 48 extends completely through the handle bezel 24 to allow the cover 46 to move through the wall member 28 to provide access to the first fastener 22.

As shown in FIG. 3, the handle bezel 24 includes a flexible locking portion 50. Preferably, the flexible locking portion 50 is integrally formed with the handle bezel 24 as a single, one-piece member. The flexible locking portion 50 is connected to the handle bezel 24 and has an outer surface 50A facing toward the interior of the vehicle. A first protrusion 52 extends outwardly from the outer surface 50A proximal a free end of the flexible locking portion 50. A second protrusion 54 extends outwardly from the outer surface 50A of the flexible locking portion 50 proximal a fixed end of the flexible locking portion 50. The first protrusion 52 is spaced from the second protrusion 54, as shown in FIGS. 3 and 5, in a direction of movement of the cover 46 (indicated by the arrow in FIG. 5).

The cover 46 includes a first notch 56 that engages the first protrusion 52 when the cover is in the first, or closed, position as shown in FIG. 3. The first notch 56 engages the first protrusion 52 in the first position to substantially prevent movement of the cover 46 out of the first position toward the second position. The first notch 56 engages the second protrusion 54 when the cover is in the second, or open position, as shown in FIG. 5. The first notch 56 is formed in an outer surface 46A of the cover that faces toward the outer closure panel 16. The first notch 56 engages the second protrusion 54 in the second position to substantially prevent movement of the cover 46 out of the second position toward the first position.

A second notch 58 is formed in an inner surface 46B of the cover 46, as shown in FIGS. 2-5. Preferably, the second notch 58 is disposed at a lowermost end of the cover 46. The handle 38 preferably conceals the second notch 58 from view when the cover 46 is in the first position. The second notch 58 is configured to be engaged by a tool, such as a screw driver, to move the cover 46 from the first position to the second position. Engaging the second notch 58 with a tool and pushing the cover 46 upwardly towards the slot 48 causes the cover 46 to move upwardly through the slot 48 in the bezel 24. The force exerted on the cover 46 by the tool causes the flexible locking portion 50 of the bezel 24 to flex outwardly, that is, in a direction away from the cover 46, such that the first protrusion 52 disengages the first notch 56 to allow movement of the cover 46 from the first position (FIG. 3) to the second position (FIG. 5). The first notch 56 engages the second protrusion 54, thereby stopping further upward movement of the cover 46.

Force is exerted on an upper end of the cover 46 to return the cover 46 to the second position to cover the first fastener 22 and prevent access thereto. The force exerted on the upper end of the cover 46 causes the second protrusion 54 to flex outwardly (i.e., away from the cover 46), thereby disengaging the first notch 56 and allowing downward movement of the cover 46 in the direction indicated by the arrow in FIGS. 4 and 5.

As shown in FIGS. 3 and 5, the cover 46 slides between the first and second positions in a vertical direction. The cavity 17 between the outer and inner closure panels 14 and 16, respectively, accommodates the cover 46 as the cover moves from the first position (FIG. 3) to the second position (FIG. 5). The slot 48 facilitates guiding the sliding movement of the cover 46 between the first and second positions within the same plane. Alternatively, the slot can be disposed in any suitable portion of the wall member 28 of the bezel 24 to facilitate moving the cover 46 between the first and second positions.

Figure 6:
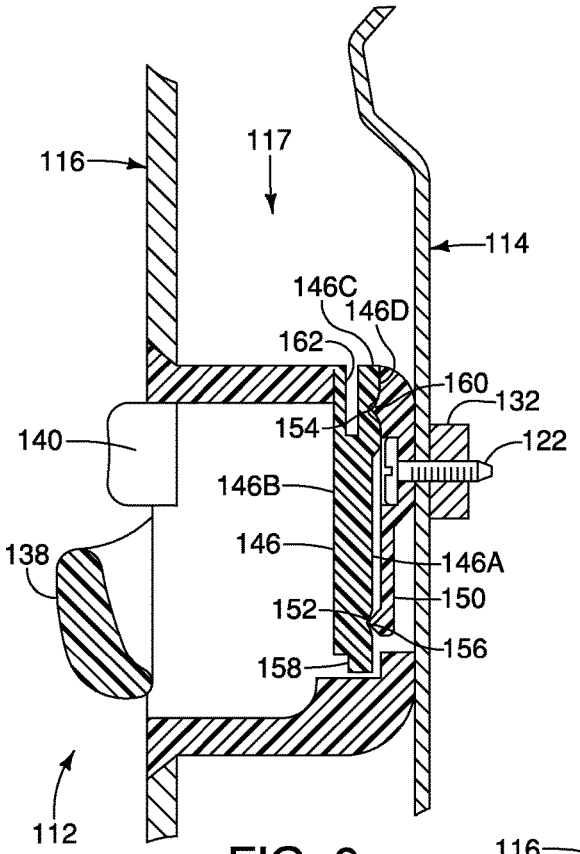
FIG. 6 is a front elevational view of a handle bezel assembly in accordance with another exemplary embodiment of the present invention.
Figure 7:
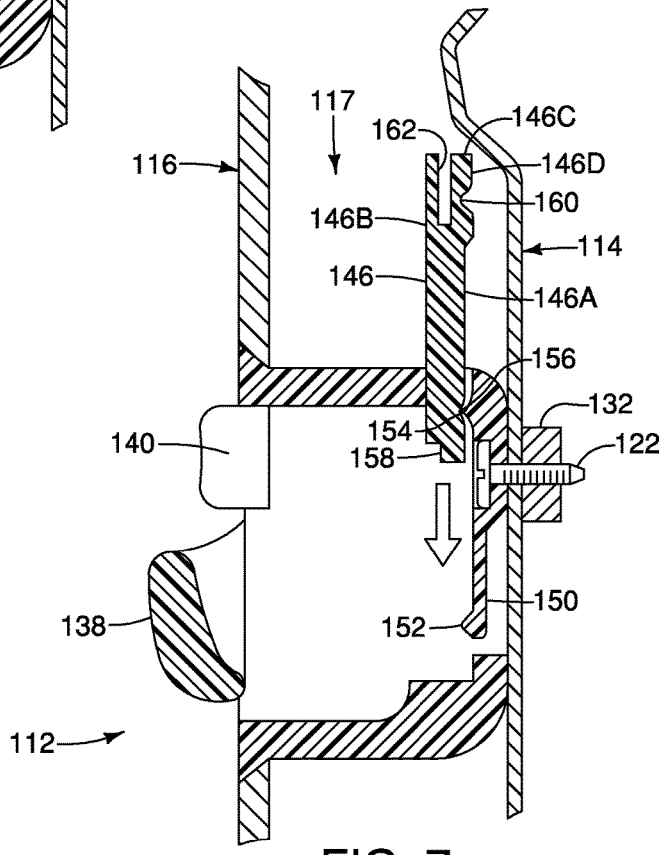
FIG. 7 is a side elevational view in cross section of the handle bezel assembly of FIG. 6 with the cover in a second position.

As shown in FIGS. 6 and 7, a handle bezel assembly 112 in accordance with a second exemplary embodiment of the present invention is substantially similar to the handle bezel assembly 12 of the first exemplary embodiment except for the differences described below. Similar parts are identified with similar reference numerals, except increased by 100 (i.e., 1xx, accordingly).

A cover 146 in accordance with the second exemplary embodiment includes a third notch 160 disposed in the outer surface 146A of the cover member 46, as shown in FIGS. 6 and 7. The third notch 160 is spaced from the first notch 156 in the outer surface 146A of the cover 146. The third notch 160 is spaced from the first notch 156 in the direction of movement of the cover 146 between the first and second positions.

In the first position, the first notch 156 of the cover 146 engages the first protrusion 152 of the flexible locking member 150 and the third notch 160 engages the second protrusion 154. In the second position, the first notch 156 of the cover 146 engages the second protrusion 154 of the flexible locking member 150, and the third notch 160 of the cover does not engage the flexible locking member 150.

To facilitate moving the cover 146, a recess 162 is formed in an end surface 146C of the cover 146. The recess 162 extends inwardly from the end surface 146C in the movement direction of the cover 146, thereby forming a flexible portion 146D of the cover 146. The third notch 160 is formed in the flexible portion 146D of the cover 146. Accordingly, when a tool engages the second notch 158 in the cover 146 to move the cover 146 from the first position (FIG. 6) to the second position (FIG. 7), the flexible portion 146D of the cover 146 flexes inwardly (i.e., toward the recess 162) to facilitate disengaging the second protrusion 154 from the third notch 160. The remaining structure and operation of the bezel handle assembly 112 in accordance with the second exemplary embodiment of the present invention is substantially similarly to the bezel handle assembly 12 described in accordance with the first exemplary embodiment of the present invention.

As shown in FIGS. 8-11, a handle bezel assembly 212 in accordance with a third exemplary embodiment of the present invention is substantially similar to the handle bezel assembly 12 of the first exemplary embodiment except for the differences described below. Similar parts are identified with similar reference numerals, except increased by 200 (i.e., 2xx, accordingly).

Figure 8:
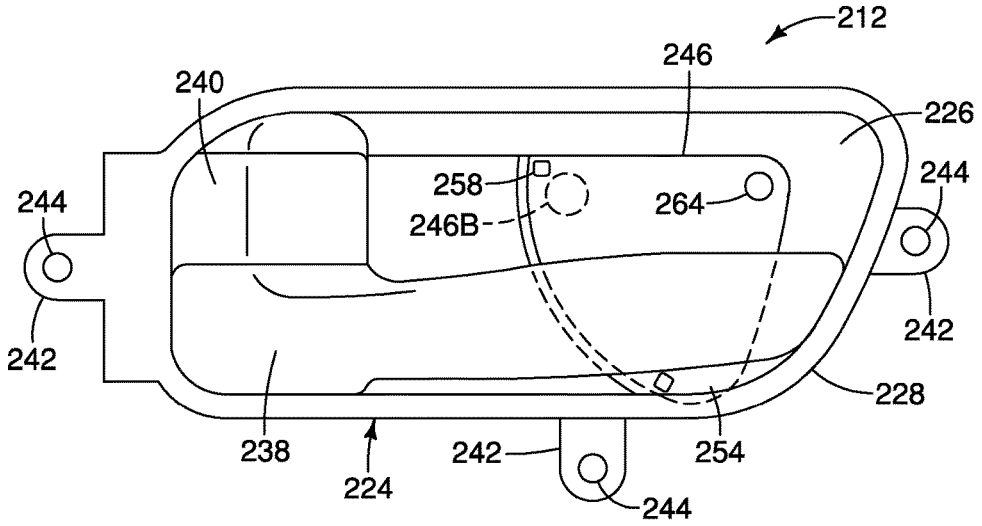
FIG. 8 is a side elevational view of a handle bezel assembly in accordance with another exemplary embodiment of the present invention.
Figure 9:
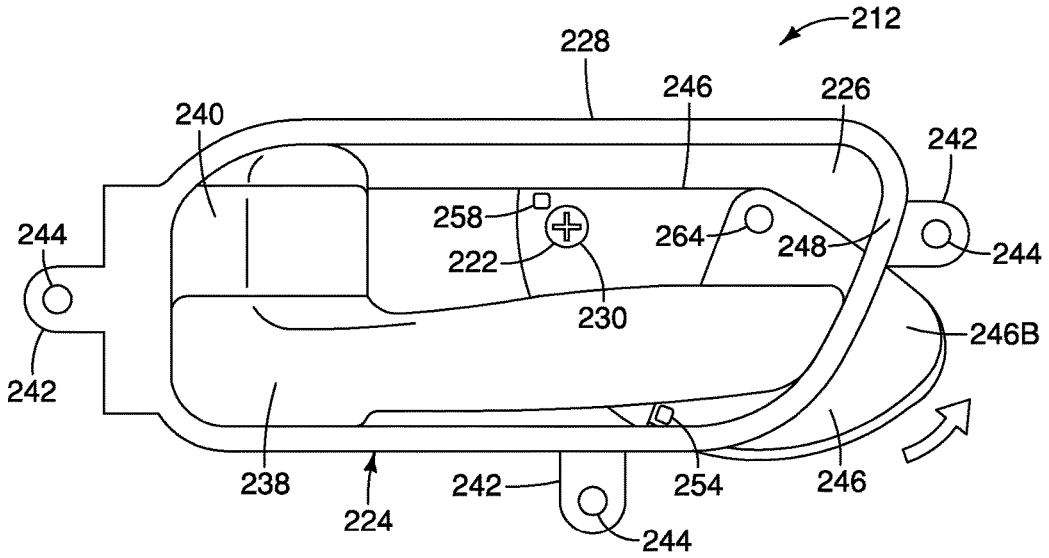
FIG. 9 is a side elevational view of the handle bezel assembly of FIG. 8 in which the cover is moved to a second position.
Figure 10:
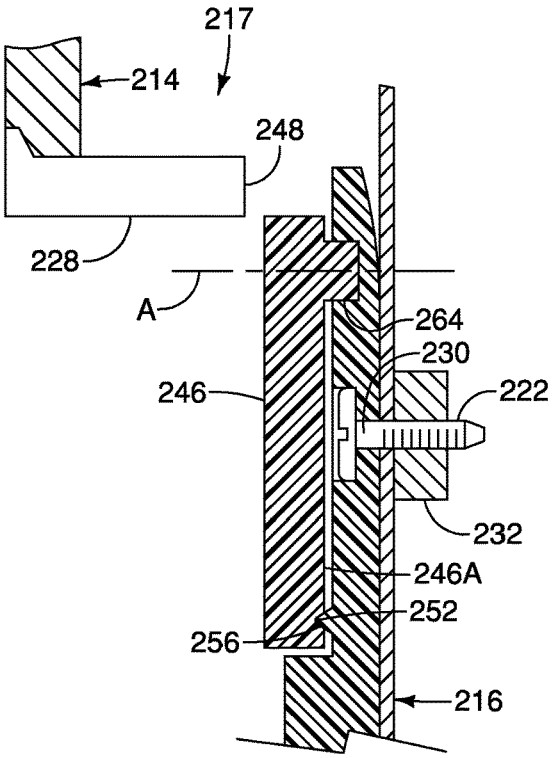
FIG. 10 is a front elevational view in cross section of the handle bezel assembly of FIG. 8 in which the cover is in a first position.
Figure 11:
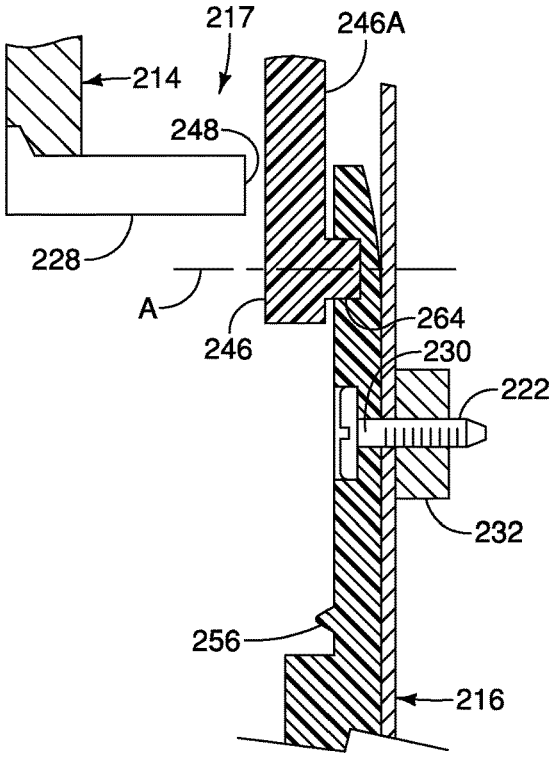
FIG. 11 is a front elevational view in cross section of the handle bezel assembly of FIG. 8 in which the cover is in a second position.

A cover 246 in accordance with the second exemplary embodiment includes a cover 246 configured to pivot between a first position in which access to the first fastener 222 is prevented (FIGS. 8 and 10) and a second position in which the first fastener 222 is accessible (FIGS. 9 and 11). As shown in FIGS. 8 and 10, the first fastener 222 is covered by the cover 246, thereby preventing access to the first fastener 222. As shown in FIGS. 9 and 11, the cover 246 is pivoted about the pivot axis A to the second position, such that the first fastener 222 is accessible. As indicated by the arrow in FIG. 9, the cover 246 pivots in the counterclockwise direction when moving from the first position to the second position. The slot 248 is preferably provided in a side portion of the wall member 228 to accommodate the pivotal movement of the cover 246 about the pivot axis A. Alternatively, the slot 248 can be provided in any suitable position in the wall member 228 to accommodate pivotal movement of the cover 246.

A pin member 264 is pivotally received by the base member 226 of the bezel 224, as shown in FIGS. 8-11, thereby allowing pivotal movement about the pin member 264. The pin member 264 allows the cover 246 to pivot about a pivot axis A during pivotal movement between the first position and the second position. The pivotal movement of the cover 246 between the first and second positions is substantially within the same plane. The pin member 264 is preferably integrally formed with the cover 246 as a single member.

As shown in FIGS. 8 and 9, a first notch 258 is provided in the inner surface 246B. The first notch 258 is configured to be engaged by a tool, such as a screw driver, to facilitate pivoting the cover 246 between the first and second positions.

A second notch 256 is disposed in the outer surface 246A, as shown in FIG. 10. A first protrusion 252 disposed on the base member 226 of the handle bezel 224 engages the second notch 256 to facilitate maintaining the cover 246 in the first position. A second protrusion 254 disposed on the base member 226 of the handle bezel 224 engages the second notch 256 to stop further pivotal movement of the cover 246 and to facilitate maintaining the cover 246 in the second position. Additionally, a mounting tab 242 can be suitably disposed to act as a stop when moving the cover to the second position, as shown in FIG. 9. Engaging the first notch 258 with a tool to pivot the cover 246 in the counterclockwise direction provides sufficient force to overcome the retention force between the second notch 256 and the first protrusion 252, such that the cover 246 can be moved from the first position to the second position. Manually pushing the cover 246 in the clockwise direction to return the cover to the first position from the second position provides sufficient force to overcome the retention force between the second notch 256 and the second protrusion 254.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above exemplary embodiment, the following directional terms "forward", "rearward", "above", "downward", "vertical", "horizontal", "below" and "transverse" as well as any other similar directional terms refer to those directions of a vehicle.

The terms of degree such as "substantially", "generally", "about" and "approximately" as used herein mean a reasonable amount of deviation of the modified term such that the end result is not significantly changed.

While only selected exemplary embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another exemplary embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature. Thus, the foregoing descriptions of the exemplary embodiments according to the present invention are provided for illustration only, and not for the purpose of limiting the invention as defined by the appended claims and their equivalents.

What is claimed is:

1. A handle bezel assembly for a vehicle, comprising:

a handle bezel having a first fastener opening formed therein, the first fastener opening being configured to receive a first fastener to secure the handle bezel to a closure panel assembly; and a cover movably connected to the handle bezel, the cover being movable between a first position preventing access to the first fastener opening and a second position allowing access to the first fastener opening.

2. The handle bezel assembly according to claim 1, further comprising a handle pivotably connected to the handle bezel.

3. The handle bezel assembly according to claim 1, wherein a plurality of mounting tabs extending outwardly from an outer periphery of the handle bezel, each of the mounting tabs having a second fastener opening configured to receive a second fastener to secure the handle bezel to the closure panel assembly.

4. The handle bezel assembly according to claim 1, wherein a flexible locking portion connected to the handle bezel, the flexible locking portion having a first protrusion and a second protrusion spaced from the first protrusion, the first protrusion being configured to engage the cover in the first position and the second protrusion being configured to engage the cover in the second position, the cover being substantially prevented from moving when engaging either of the first and second protrusions.

5. The handle bezel assembly according to claim 4, wherein a first notch formed in the cover is configured to receive the first protrusion in the first position and the second protrusion in the second position.

6. The handle bezel assembly according to claim 5, wherein a second notch formed in a flexible portion of the cover is configured to receive the second protrusion of the bezel in the first position.

7. The handle bezel assembly according to claim 4, wherein the flexible locking portion is integrally formed as a single member with the handle bezel.

8. The handle bezel assembly according to claim 1, wherein a slot is formed in the handle bezel to accommodate movement of the cover between the first and second positions.

9. The handle bezel assembly according to claim 1, wherein a notch is formed in the cover, the notch being configured to receive a tool to move the cover from the first position to the second position.

10. The handle bezel assembly according to claim 1, wherein movement of the cover between the first and second positions is within a same plane.

11. The handle bezel assembly according to claim 1, wherein the cover slides vertically between the first and second positions.

12. The handle bezel assembly according to claim 1, wherein a pin member pivotally connects the cover to the handle bezel to allow pivotal movement of the cover between the first and second positions.

13. The handle bezel assembly according to claim 1, wherein the pin member is integrally formed with the cover as a single member.

14. A closure panel assembly for a vehicle, comprising:

an outer closure panel;

an inner closure panel mounted to the outer closure panel; and a handle bezel having a fastener opening and at least one mounting tab opening, the fastener opening receiving a first fastener to secure the handle bezel to the inner closure panel, the at least one mounting tab opening receiving a second fastener to secure the handle bezel to the outer closure panel; and a cover movably connected to the handle bezel, the cover being movable between a first position preventing access to the first fastener and a second position allowing access to the first fastener.

15. The closure panel assembly for a vehicle according to claim 14, wherein a flexible locking portion connected to the handle bezel, the flexible locking portion having a first protrusion and a second protrusion spaced from the first protrusion, the first protrusion being configured to engage the cover in the first position and the second protrusion being configured to engage the cover in the second position, the cover being substantially prevented from moving when engaging either of the first and second protrusions.

16. The closure panel assembly for a vehicle according to claim 15, wherein a first notch formed in the cover is configured to receive the first protrusion in the first position and the second protrusion in the second position.

17. The closure panel assembly for an electric vehicle according to claim 14, wherein a slot is formed in the handle bezel to accommodate movement of the cover between the first and second positions.

18. The closure panel assembly for a vehicle according to claim 14, wherein a notch is formed in the cover, the notch being configured to receive a tool to move the cover from the first position to the second position.

19. The closure panel assembly for a vehicle according to claim 14, wherein movement of the cover between the first and second positions is within a same plane.

20. The closure panel assembly for a vehicle according to claim 14, wherein a nut fixed to the inner closure panel receives the first fastener.

* * * * *